US005655461A

United States Patent [19]

Gilbert

[11] Patent Number: 5,655,461

[45] Date of Patent: Aug. 12, 1997

[54] ROBBERY DETERRENT SYSTEM FOR CONVENIENCE STORES

[75] Inventor: Wayne A. Gilbert, Gilbert, Ariz.

[73] Assignee: RDS Family Limited Partnership, Santa Rita, Ariz.

[21] Appl. No.: 356,897

[22] Filed: Dec. 15, 1994

[51] Int. Cl.[6] ..... G08B 15/02

[52] U.S. Cl. ..... 109/20; 109/25; 109/29; 109/32; 340/522; 340/540; 340/691

[58] Field of Search ..... 109/20, 29, 21, 109/25, 30–34; 340/522, 540, 691

[56] References Cited

U.S. PATENT DOCUMENTS

| | | | |
|---|---|---|---|
| 2,072,941 | 3/1937 | Burch, Jr. et al. | 109/29 |
| 3,230,912 | 1/1966 | Hohmann | 109/20 |
| 3,303,592 | 2/1967 | Harner | 42/1 |
| 3,915,103 | 10/1975 | Rupert et al. | 109/20 X |
| 4,035,792 | 7/1977 | Price et al. | 109/54 X |
| 4,091,366 | 5/1978 | Lavallee | 340/258 R |
| 4,120,305 | 10/1978 | Rhoads et al. | 128/405 |
| 4,461,221 | 7/1984 | Schandle et al. | 109/6 |
| 4,841,752 | 6/1989 | Fletcher | 109/29 X |
| 4,867,076 | 9/1989 | Marcone | 109/29 X |
| 5,195,488 | 3/1993 | Sims | 109/6 |
| 5,552,766 | 9/1996 | Lee et al. | 109/3 X |

FOREIGN PATENT DOCUMENTS

| | | | |
|---|---|---|---|
| 2204304 | 8/1973 | Germany | 109/20 |

OTHER PUBLICATIONS

Advertisement "First Defense", by Defense Technology Corp. Of America, Mar. 1993.

*Primary Examiner*—Lloyd A. Gall

*Attorney, Agent, or Firm*—O'Connor Cavanagh; John D. Titus

[57] ABSTRACT

A robbery deterrent apparatus and method is provided for convenience stores or other businesses vulnerable to armed robbery, in which a would-be armed robber is incapacitated by an aerosol agent that is delivered in a predetermined pattern within the store. In a preferred embodiment, the aerosol incapacitating agent is delivered immediately upon the detection of a firearm discharge, or after a short delay in response to an employee activated trigger. The aerosol incapacitating agent may be accompanied by a marking agent, such as ultraviolet dye, to assist authorities in capturing and identifying the would-be armed robber in the event he or she is able to escape the store after the robbery attempt.

9 Claims, 4 Drawing Sheets

ROBBERY DETERRENT SYSTEM FOR CONVENIENCE STORES

BACKGROUND OF THE INVENTION

Convenience stores are often prime targets for armed robbers. Many are open throughout the night, in dangerous neighborhoods, staffed by a solitary, or at most, two cashiers. Various measures have been taken by the owners and operators of such stores to reduce robbery-associated losses without increasing the danger to the cashiers or other employees, or to innocent bystanders. Such measures include the use of a safe that cannot be opened by the cashier, but which has a "mail slot" or other similar opening into which the cashier can deposit, but cannot withdraw, cash. Other measures include surveillance cameras, which photograph the robber to assist in his or her later apprehension, silent alarms, which notify local police of the robbery, and measuring tapes affixed to the doorways, which assist the cashier in determining the height of the robber for later description to police.

To avoid the likelihood of the robber injuring, or possibly killing the cashier or bystanders, cashiers are usually instructed to cooperate fully with the robber. Cashiers are also instructed to note the physical appearance of the robber for later description to police. However, owing to the extreme circumstances, and the fact that robbers may wear masks or stockings to distort their features, cashiers are often unable to give exact descriptions, or even to identify the robber in the unlikely event he or she is later captured. According to the National Crime Victimization Survey by the Bureau of Justice Statistics, in 1993 1.3 million robberies were attempted in the United States, of these, some 826,000 were successfully completed.

Even more disturbing, however, is a trend that has recently evolved in the behavior of convenience store robbers. For whatever reasons, be it to eliminate witnesses, or to prevent the triggering of silent alarms, convenience store robbers have begun simply to shoot the cashier and other employees immediately upon entering the store and to carry out the robbery after killing all others present.

Although it would theoretically be possible to train cashiers in armed self defense and permit them to shoot it out with this new breed of convenience store robber, the potential for further loss of life would be exacerbated. A store cashier could not possibly remain vigilant at all times, nor could a cashier be expected to assess a particular situation and make the decision to use deadly force before a robber, who has already made the decision to use deadly force, could carry out his or her plan. Accordingly, even a well trained cashier would, in all probability be killed by the armed robber, simply because of the difficulty an ordinary person has in making the decision to use deadly force. Moreover, the possibility that a cashier could accidentally shoot an innocent patron makes the foregoing strategy entirely unacceptable.

What is needed then is a system that will deter this new breed of convenience store robber by ensuring that the robber will be incapacitated automatically upon the discharge of his or her weapon, without the cashier being required to make a decision to use deadly force. What is also needed is a non-lethal robbery deterrent system that will permit a cashier to protect himself or herself from an armed robber without having to make a decision to use deadly force.

Accordingly, it is a principal object of the present invention to provide a method and apparatus for deterring convenience store robberies by delivering a non-lethal incapacitating agent onto a robber automatically upon the discharge of a firearm within the store.

Another significant object of the invention is to provide for a cashier or employee initiated system for delivering a non-lethal incapacitating agent onto a robber who has not yet discharged a firearm within the store, but who may be threatening to do so.

Another significant object of the invention is to provide a system for physically marking an armed robber so that, in the event the armed robber recovers from the incapacitating agent in time to escape before police arrive, apprehension of the robber will be facilitated.

SUMMARY OF THE INVENTION

According to the present invention a robbery deterrent system is provided for convenience stores and other retail establishments, banks, or other businesses vulnerable to armed robbery. The present invention comprises means for delivering an effective dose of a non-lethal incapacitating agent over a substantial area within the establishment to incapacitate the would-be robber. In one embodiment of the present invention, the delivery means is responsive to detection of a firearm discharge within the premises. In another embodiment of the invention, the delivery means is controllable by the employee. The incapacitating agent can be delivered with or without a marking agent, such as ultraviolet dye. The marking agent serves to assist the authorities in apprehending the would-be robber in the event he or she is able to quit the establishment and attempt an escape, and serves as circumstantial evidence that the individual was attempting a robbery.

BRIEF DESCRIPTION OF THE DRAWINGS

The above and other objects, aspects, features and attendant advantages of the present invention will become apparent from a consideration of the ensuing detailed description of presently preferred embodiments and methods thereof, taken in conjunction with the accompanying drawings, in which.

DESCRIPTION OF PREFERRED EMBODIMENTS AND METHODS

Figure 1:
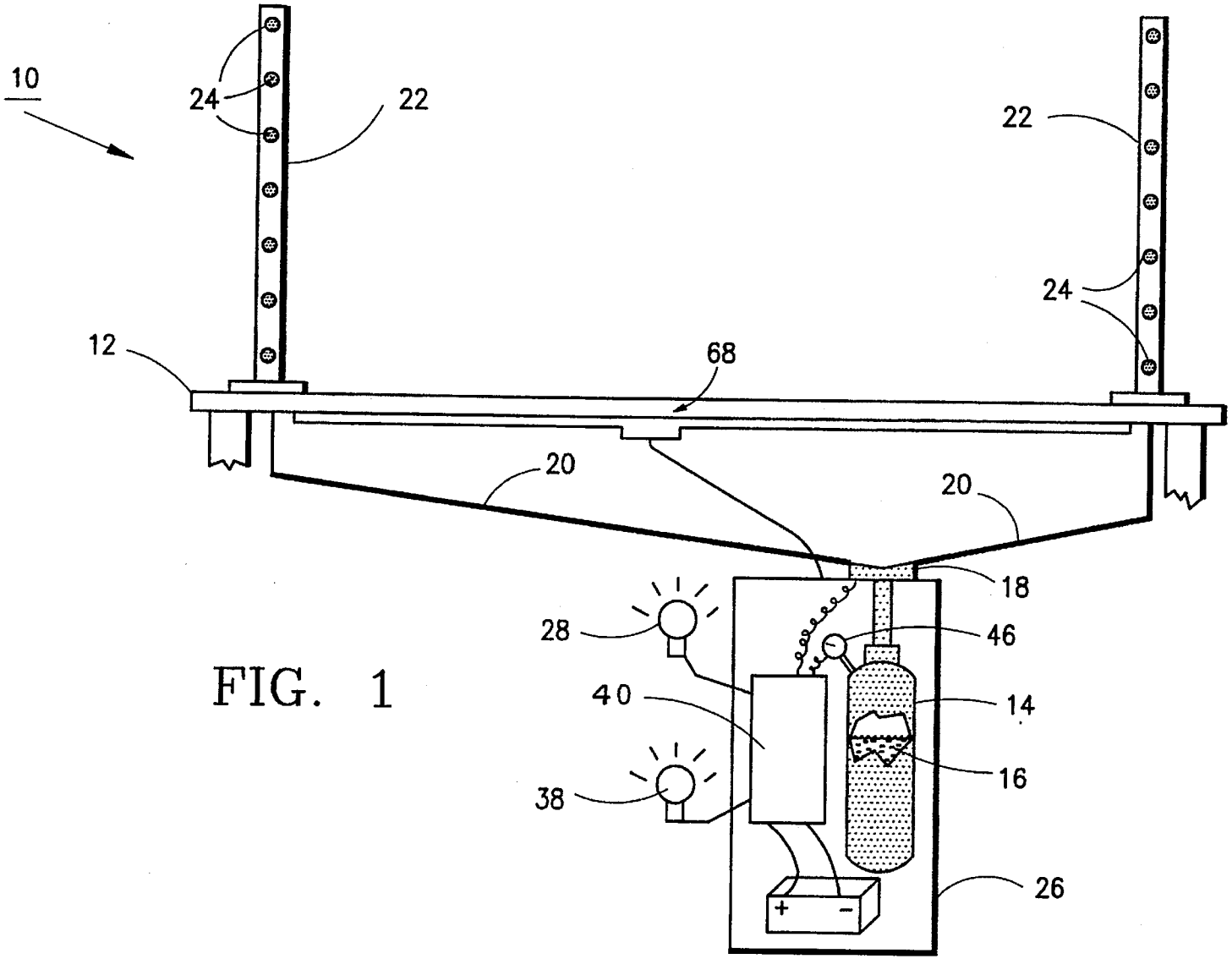
FIG. 1 is an illustration of a service counter cutaway to show features of an embodiment of the present invention.

FIG. 1 is an illustration of a typical convenience store transaction counter cutaway to show features of a counter discharge system 10 incorporating features of the present invention. Counter 12 is enclosed on all sides except the side that ordinarily faces the cashier. Beneath counter 12 is a pressurized container 14 of a non-lethal incapacitating agent 16, such as an aerosol carrier of 50% water 35% denatured alcohol and 5% propylene glycol containing 10% Oleoresin Capsicum, (U.S. Pat. No. 5,217,708), available commercially from Defense Technology Corporation of America as "First Defense®."

The pressurized container 14 is prevented from discharging by solenoid valve 18. Connected to the fluid output of solenoid valve 18 is distribution manifold 20, which is in communication with discharge manifolds 22. A plurality of discharge nozzles 24 are attached to and in communication with discharge manifolds 22 and are arranged to spray a pattern of incapacitating agent 16 over a region in front of the counter where an armed robber would most likely be standing, preferably a distance of about 0 to 20 feet, but most preferably from about 4 to 8 feet in front of the counter. The pattern also extends for a distance of up to approximately 10 feet, but preferably about 4 feet beyond the counter at both ends. Discharge manifolds 22 are preferably concealed to avoid intimidating legitimate patrons and may be incorporated in a structure supporting overhead signs.

Figure 4:
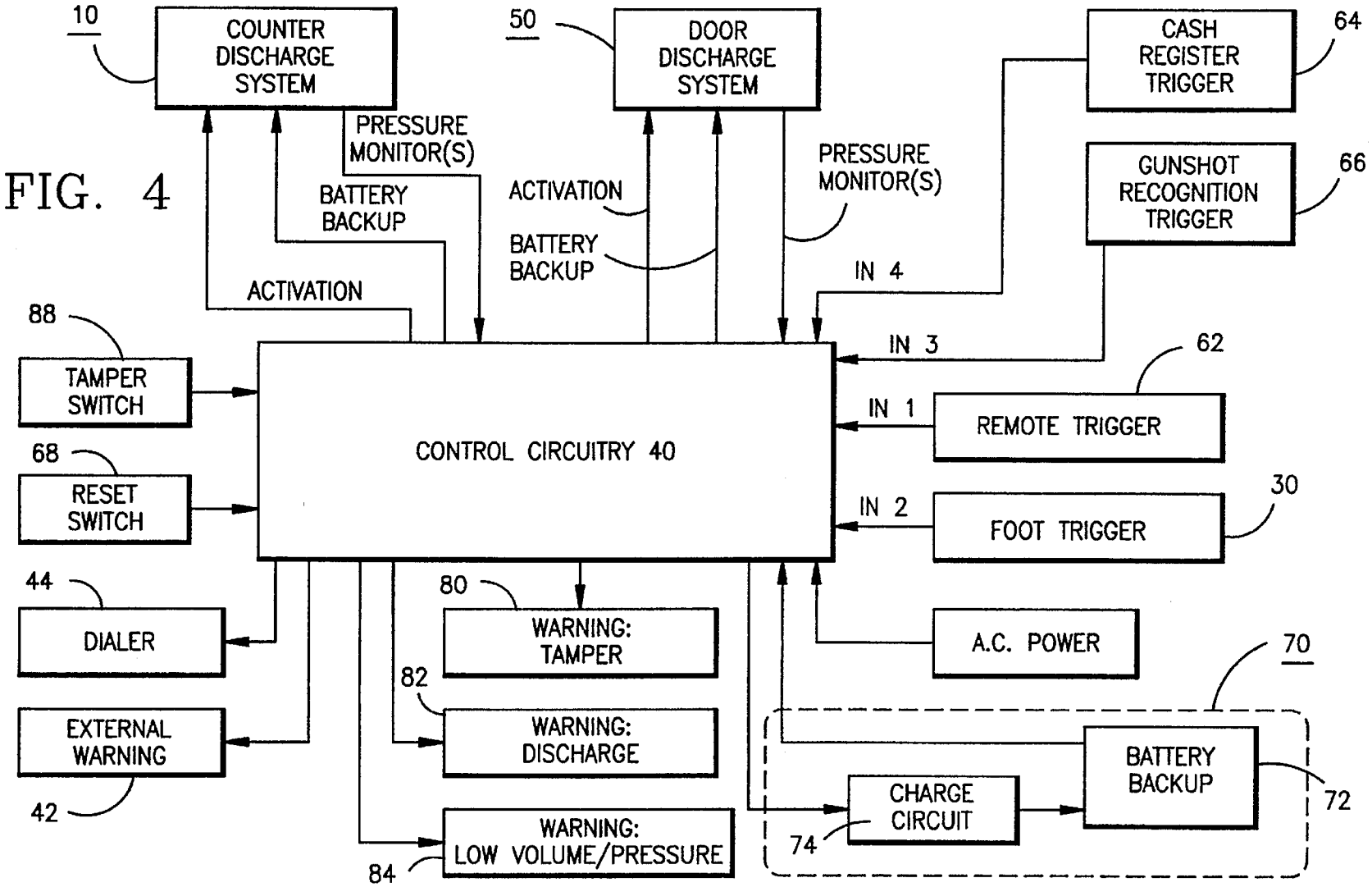
FIG. 4 is a block diagram of the logic controls of an embodiment of the present invention.

Control circuitry 40, discussed more fully with reference to FIG. 4, comprises means for sensing input from one of a plurality of triggers. In operation, control circuitry 40 responds to a trigger input by opening solenoid valve 18 either instantaneously or after a predetermined delay. Once solenoid valve 18 is opened, incapacitating agent 16 fills discharge manifolds 22 via distribution manifold 20 and is dispersed in a predetermined pattern through nozzles 24 to incapacitate any person standing inside the region defined by the predetermined pattern.

Although use of a pressurized aerosol distributed through a system of manifolds and nozzles is disclosed in the preferred embodiment, other means of containing a nonlethal incapacitating agent and discharging it in response to a trigger may be used within the scope of the invention. For example, it may be practicable to distribute a plurality of containers each containing a dry incapacitating agent in place of the nozzles and to discharge the agent using a plurality of pyrotechnic gas generators such as those used in automobile air bags.

Figure 2A:
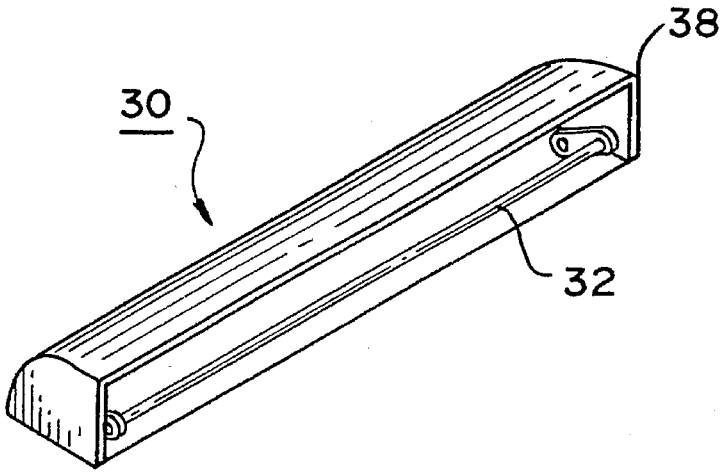
FIG. 2A is a perspective view and FIG. 2B a cross sectional view of a foot operated trigger according to an embodiment of the present invention.
Figure 2B:
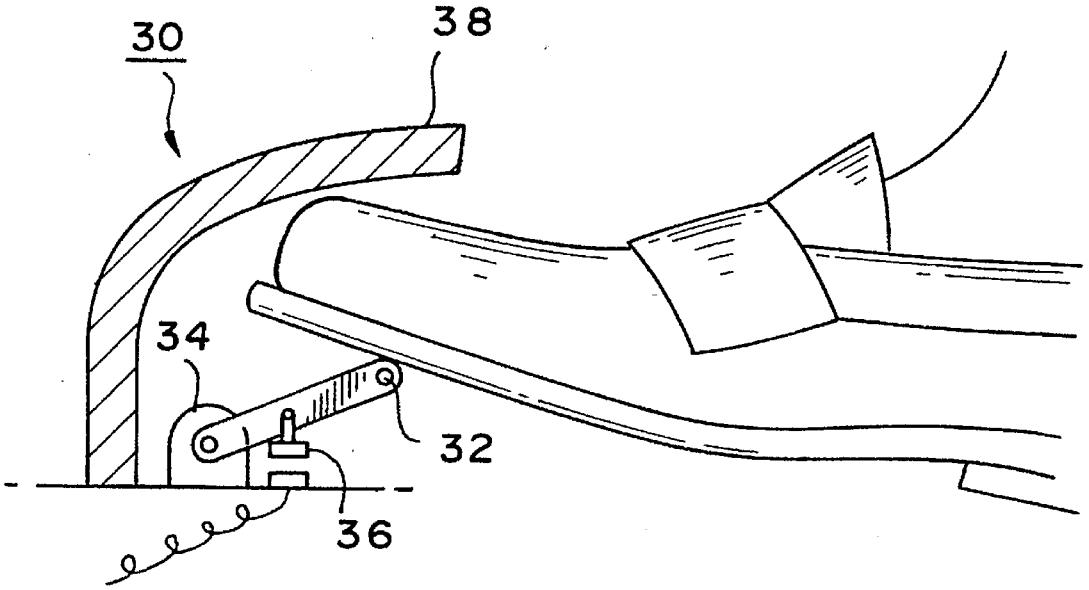

FIG. 2A is a perspective view and FIG. 2B a cross sectional view of foot trigger 30, which may be a conventional conductive rubber tread switch such as that used to operate automatic doors, or, preferably, a foot pedal comprising an elongate rod 32 running substantially the length of counter 12. Rod 32 is pivotally attached to a pair of pivots 34 and is biased away from the floor. Shield 38 covers rod 32 to prevent accidental activation of foot trigger 30. During a robbery, if the cashier feels it is safe to do so, the cashier steps on foot trigger 30, causing contact 36 to meet, thereby triggering control circuit 40 to initiate a discharge of incapacitating agent. Other manually operated switches, including a simple button under the counter are also feasible for signalling control circuit 40 to initiate a discharge.

Figure 3:
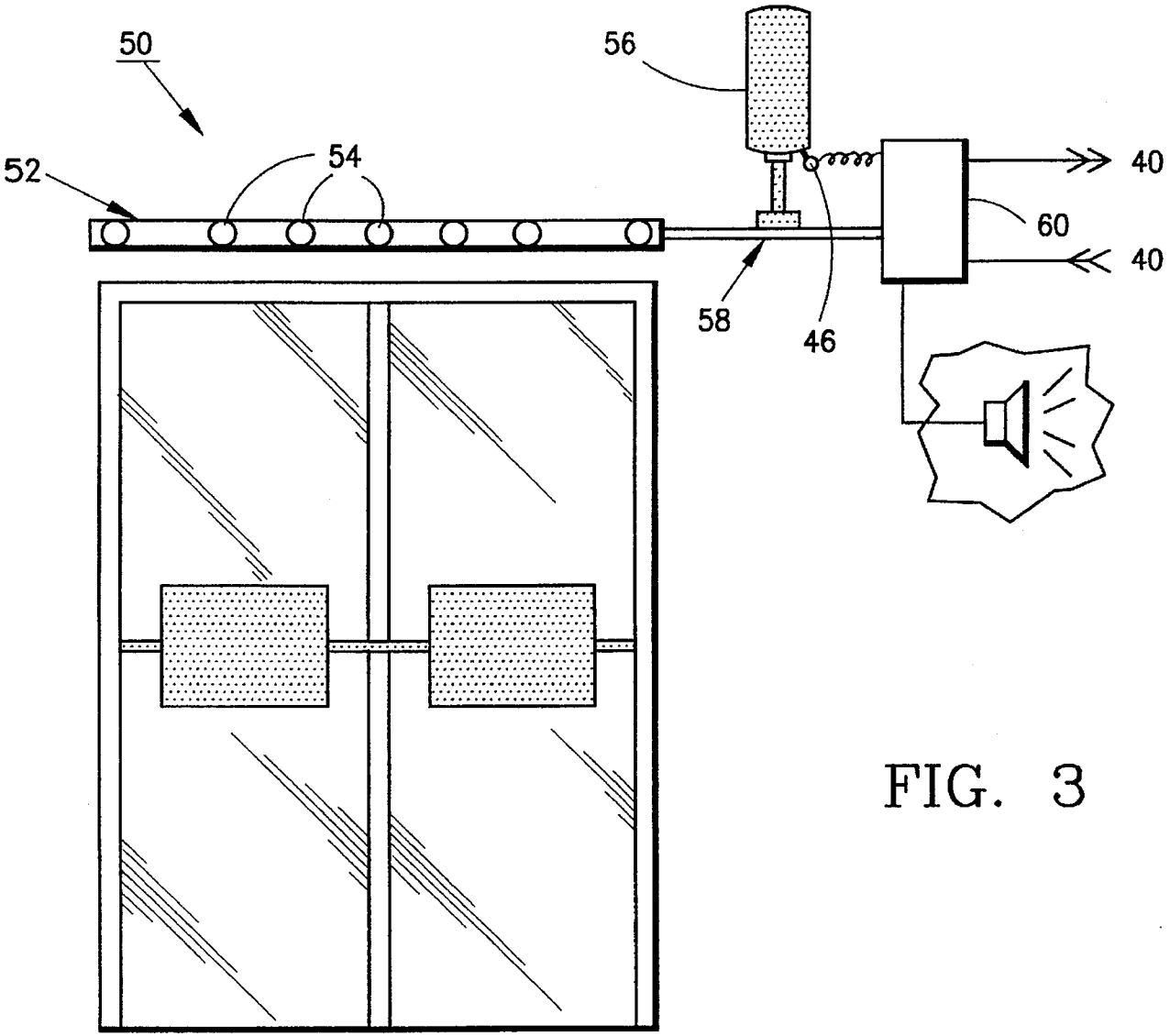
FIG. 3 is an illustration of a building entrance incorporating features of an embodiment of the present invention.

FIG. 3 illustrates additional features of an embodiment of the present invention including an additional doorway discharge system 50. Doorway discharge system 50 comprises an additional discharge manifold 52 is mounted proximal to the doorway. Additional nozzles 54 are arranged to deliver a predetermined pattern of incapacitating agent proximal to the doorway to incapacitate the would-be robber's accomplice, if present, and to prevent the would-be robber's escape. Depending on the particular configuration of the store, discharge manifold 52 may be fed directly from distribution manifold 20, or, as shown in FIG. 3, may be fed via supplemental pressurized container 56 and supplemental solenoid valve 58, which may be locally actuated by secondary controller 60. If a supplemental container is used, controller 40 may be programmed to signal secondary controller 60 to open supplemental solenoid valve 58 an appropriate period of time after controller 40 signals solenoid valve 18 to open. Depending on the exact configuration of the store, additional discharge manifolds may be located throughout the building to deliver a predetermined pattern of incapacitating agent in all critical areas.

FIG. 4 is a block diagram of an embodiment of controller 40 and its interfaces. Trigger inputs comprise remote trigger 62, foot trigger 30, cash register trigger 64, and gunshot recognition trigger 66.

Cash register trigger 64 comprises a sensor within a cash register commonly used in convenience stores. In one embodiment, the cash register trigger comprises a button on the register that opens the register and simultaneously initiates a trigger event. In another embodiment, a sensor within the cash drawer of the cash register initiates a trigger event in the event cash is removed from a particular area of the cash drawer. This latter sensor may be of the type disclosed in U.S. Pat. No. 4,461,221 to Schandle, et al.

Gunshot recognition trigger 66 comprises a microphone or other sound detection means operating alone or in conjunction with a photodetector. In the event a firearm is discharged within the building, gunshot recognition trigger 66 detects the sound and generates a trigger signal to controller 40. Gunshot recognition trigger distinguishes the sound of a firearm discharge from other sounds by a combination of conventional amplitude and frequency selection, which may include band pass filtering and/or fast fourier transform spectrum analysis. Further signature discrimination may be achieved using a photodetector, which detects the visible and infrared electromagnetic signature of a firearm discharge. Requirement that a discharge of incapacitating agent be initiated only in the event a combination of valid sonic and electromagnetic signatures are simultaneously detected further ensures against accidental discharge.

Remote trigger 62 comprises a small conventional coded signal transmitter, such as those used for remote keyless entry systems for automobiles and the like. Remote trigger 62 may be carried or worn by an employee to activate the system from a remote location within the building at times when reaching the foot or cash register trigger would be impracticable.

The preferred embodiment includes uninterruptable power supply 70, which may comprise a reserve battery 72 with charging and monitoring circuitry 74, or another conventional uninterruptable power supply system. Preferably the uninterruptable power supply should be of sufficient reserve capacity to maintain functionality of the system for a period of about 6–24 hours after a power failure and thereafter to operate the system in the event of a robbery. Uninterruptable power supply 70 also provides power to counter discharge system 10 and door discharge system 50 through control circuitry 40.

Control circuitry 40 is preferably mounted within locked housing 26, as shown in FIG. 1. In the event locked housing 26 is opened, tamper switch 88, which comprises a conventional Microswitch® mounted to the door, will signal control circuitry 40. Circuitry 40 will, in turn, signal that a tampering event has occurred by altering the signal to tamper warning/status indicator 80, which is preferably a conventional light emitting diode mounted so as to be visible from the exterior of housing 26. Indicator 80 remains in the tamper warning mode until an authorized user enters the proper codes to reset indicator 80. Control circuitry 40 also monitors pressure in container 14 via a pressure monitoring device 46, preferably comprising a solid-state pressure sensor. In the event the pressure in container 14 leaks below a predetermined level, pressure sensor 46 signals control circuitry 40, which in turn indicates a low pressure condition by illuminating low pressure indicator 84. Similarly, control circuitry monitors pressure in container 56 via a similar pressure monitoring device 46. Indicator 84 is preferably a conventional light emitting diode mounted so as to be visible from the exterior of housing 26.

In a preferred embodiment, controller 40 continuously monitors the trigger input lines for a trigger signal from foot bar trigger 30, remote trigger 62, cash register trigger 64, or gunshot recognition trigger 66. In the event a trigger signal is received from foot bar trigger 30, remote trigger 62, or cash register trigger 64, control circuitry 40 immediately activates employee warning device 82, which may be a light located within the cashier's view or a vibrating pager, which selectively alerts the cashier that a discharge event has been triggered and gives the cashier a reasonable period of time, preferably about 2–15 seconds to prevent an accidental discharge by pressing reset switch 68.

If the system is not reset within the predetermined period, the controller will activate solenoid valve 18 and, after a predetermined delay, will activate supplemental solenoid valve 58 to deliver incapacitating agent 16. In the event the controller receives an input signal from the gunshot recognition trigger 66, the controller will immediately activate solenoid valve 18 and after a predetermined delay, supplemental solenoid valve 58, without the possibility of resetting the system.

Regardless of the particular trigger event, simultaneously, or shortly after activating the solenoid valves, the controller will activate the external warning indicator 42, which, as shown also in FIG. 3, comprises an external siren, flashing sign, or strobe, to warn bystanders that a robbery attempt is in progress. Controller 40 will also activate automatic dialer 44, which will inform local authorities that a robbery attempt has activated the system.

Although certain preferred embodiments and methods have been disclosed herein, it will be apparent from the foregoing disclosure to those skilled in the art that variations and modifications of such embodiments and methods may be made without departing from the true spirit and scope of the invention. Accordingly, it is intended that the invention shall be limited only to the extent required by the appended claims and the rules and principles of applicable law.

What is claimed is:

1. A method for deterring robbery of a convenience store building or other building having a doorway and a transaction area where transactions are effected, comprising:

electronically sensing the sound of a gunshot, said sound having a frequency and amplitude content;

electronically processing the frequency and amplitude content of said sound to discriminate said gunshot from other sounds, and generating a detection signal in response thereto;

discharging, in response to said detection signal, a non-lethal aerosol incapacitating agent in an amount sufficient to deliver an effective dose to substantially all of a region proximate to said transaction area; and directing said agent into said region to incapacitate persons located therein.

2. An apparatus for deterring robbery of a convenience store building or other building in which cash transactions are carried out with an employee, said building being accessible through a doorway and having a counter or other table across which said cash transactions are effected, said apparatus comprising:

a first quantity of a non-lethal incapacitating agent in an amount sufficient to deliver an effective dose to substantially all of a region proximate to said counter;

a reservoir for containing said first quantity of incapacitating agent under pressure, said reservoir having an outlet;

a manifold having an inlet in fluid communication with said reservoir outlet, said manifold terminating in a plurality of discharge nozzles capable of being located proximate to said counter;

a normally closed electrically actuated solenoid valve operatively connected between said reservoir outlet and said manifold inlet;

an electronic controller having a plurality of input signal ports for receiving a plurality of input signals, said controller further including an output port operatively connected to said electrically actuated solenoid valve, said controller being capable of receiving an input signal and, in response thereto, producing a signal at said output port capable of opening said electrically actuated solenoid valve; and a plurality of switches capable of providing controller input signals to said input signal ports, one of said plurality of switches comprising electronic means for detecting a gunshot and generating a controller input signal in response thereto, said electronic means for detecting a gunshot comprising sound detection means having amplitude and frequency waveform processing for discriminating a gunshot from other sounds.

3. The apparatus of claim 2 further including a second quantity of a non-lethal incapacitating agent in an amount sufficient to deliver an effective dose to substantially all of a region proximate to said doorway;

a second reservoir for containing said second quantity of incapacitating agent under pressure, said second reservoir having an outlet;

a second manifold having an inlet in fluid communication with said second reservoir outlet, said second manifold terminating in a plurality of discharge nozzles capable of being located proximate to said doorway;

a second normally closed electrically actuated solenoid valve operatively connected between said second reservoir outlet and said second manifold inlet; and said electronic controller further including a second output port operatively connected to said second electrically actuated solenoid valve, said electronic controller further capable of producing a signal at said second output port capable of opening said second electrically actuated solenoid valve.

4. The apparatus of claim 2 wherein said waveform processing comprises bandpass filtering.

5. The apparatus of claim 2 wherein said waveform processing comprises fast fourier transform analysis.

6. The apparatus of claim 2 further including a photodetector for sensing an infrared signature of a gunshot.

7. The apparatus of claim 2 wherein one of said plurality of switches comprises a switch responsive to opening of a cash register.

8. An apparatus for incapacitating an individual present within a predetermined target area comprising:

a pressurizable container having an outlet;

an electrically actuated solenoid valve operatively attached to and in fluid communication with said outlet;

a manifold having an inlet end, said manifold terminating in a plurality of nozzles, the inlet end of said manifold being attached to and in fluid communication with said valve, said plurality of nozzles being aimed at said predetermined target area;

a first quantity of a non-lethal incapacitating agent in an amount sufficient to deliver an effective dose to said predetermined target area;

an electronic controller responsive to a plurality of input signals, said controller operatively connected to said electrically actuated solenoid valve and capable of generating an electrical signal for opening said valve; and a plurality of switches for providing input signals to said electronic controller, one of said plurality of switches comprising electronic means for detecting a gunshot and generating a controller input signal in response thereto, said electronic means for detecting a gunshot comprising sound detection means having amplitude and frequency waveform processing for discriminating a gunshot from other sounds.

9. The apparatus of claim 8 wherein said non-lethal incapacitating agent further includes an ultraviolet dye.

* * * * *